US005989126A

United States Patent [19]

Kilbert et al.

[11] Patent Number: 5,989,126

[45] Date of Patent: Nov. 23, 1999

[54] WATER RAFT AMUSEMENT RIDE INCLUDING A DEVICE FOR SPINNING A CIRCULAR WATER RAFT

[75] Inventors: Michael G. Kilbert, Canyon Country; Mark W. Sumner, Valencia, both of Calif.

[73] Assignee: Disney Enterprises, Inc., Del.

[21] Appl. No.: 09/040,507

[22] Filed: Mar. 17, 1998

[51] Int. Cl.[6] ..... A63G 3/02

[52] U.S. Cl. ..... 472/13; 472/117; 104/70

[58] Field of Search ..... 472/13, 117, 116, 472/128, 129; 104/53, 69, 70, 73

[56] References Cited

U.S. PATENT DOCUMENTS

| | | | |
|---|---|---|---|
| 4,429,867 | 2/1984 | Barber | 472/13 |
| 4,516,943 | 5/1985 | Spieldiener et al. | 441/35 |
| 4,696,251 | 9/1987 | Spiediener et al. | 114/346 |
| 4,836,521 | 6/1989 | Barber | 472/117 |
| 5,069,443 | 12/1991 | Shiratori | 472/117 |
| 5,197,923 | 3/1993 | Barber | 472/13 |
| 5,299,964 | 4/1994 | Hopkins | 114/346 |
| 5,453,054 | 9/1995 | Langford | 472/117 |
| 5,536,210 | 7/1996 | Barber | 472/128 |
| 5,704,294 | 1/1998 | Van Winkle et al. | 104/73 |
| 5,716,282 | 2/1998 | Ring et al. | 472/117 |

*Primary Examiner*—Kien T. Nguyen
*Attorney, Agent, or Firm*—Medlen & Carroll, LLP

[57] ABSTRACT

An amusement water ride is provided including a water course for carrying one or more circular water rafts. The water course is provided with at least one downhill section for accelerating the water rafts into a splash point. A spin mechanism is provided near the top of the downhill section for imparting a spin to the water rafts as they move past the spin mechanism. The spin mechanism includes a movement retarding surface along one wall of the water course and a movement expediting surface along an opposite wall of the water course. The movement retarding surface is provided with a high friction coating which retards sliding movement in a downstream direction of the surface of the raft which contacts the movement retarding surface, and induces rotation of the raft and movement towards the opposite wall. As the raft rotates into contact with the movement expediting surface it encounters no frictional resistance, and the spin is accelerated by the force of gravity acting on the mass of the raft as it moves downhill. The spinning raft increases thrill and introduces uncertainty among the passengers regarding who will be in a position to be splashed when the raft hits the splash zone.

20 Claims, 4 Drawing Sheets

WATER RAFT AMUSEMENT RIDE INCLUDING A DEVICE FOR SPINNING A CIRCULAR WATER RAFT

FIELD OF THE INVENTION

The present invention relates to the field of amusement rides; more particularly, the present invention relates to amusement rides in which a water raft moves along a water channel.

BACKGROUND OF THE INVENTION

Among the most popular amusement rides, particularly in warmer climates and during the Summer season, are water rides. Most water rides involve a floatation device or vehicle which travels in a downstream direction along a chute or channel in which water flows. The channel is typically provided with curves and one or more downhill sections which enable the vehicle to achieve sufficient speed to impart thrill to, and splash water on, the passengers.

One such conventional flotation vehicle is a circular raft with an outer annular tube formed from rubberized material or the like, which is air filled and deformable, such as that shown, for example, in U.S. Pat. No. 4,696,251. Mounted inside the annular tube is a passenger platform including a plurality of passenger seats. This vehicle is free floating when the depth of water in the channel is sufficient, and is popular because it can bounce from one wall of the channel to the opposite wall, causing the vehicle to turn in unpredictable ways. However, the speed of the raft is typically determined by the speed of the water, and is relatively slow. Thrill can be imparted by allowing the raft to travel down an inclined, downhill section where the force of gravity can accelerate the vehicle until it encounters the pooled water at the base of the incline, causing the water to splash and spray upwards and outwards, often splashing the passengers. However, even with very steep or long inclined sections, the rafts tend to travel straight down the incline, allowing the passengers to prepare for the impact with the water at the base of the incline (the "splash point"), thus preventing the ride from being very thrilling.

Therefore, the need exists for providing a water amusement ride with more thrill, and in particular, for disorienting or otherwise preventing the passengers in the vehicle from anticipating the splash point.

SUMMARY OF THE INVENTION

In one embodiment, the present invention provides a mechanism for imparting a spin to a circular, floatation vehicle or raft in a water raft amusement ride. The spin mechanism is preferably mounted near the top of an incline, and includes a movement retarding means mounted along one wall of the channel, a movement expediting means mounted along an opposite wall of the channel, directly opposite the movement retarding means. The movement retarding means extends a sufficient distance into the channel to engage the raft and move it into contact with the movement expediting means. As the weight of the raft and water flow move it past the movement retarding means and movement expediting means, the downstream movement of the raft is simultaneously retarded on one side by the movement retarding means, and expedited on the other side by the movement expediting means, imparting a spin on the raft. Thus, if the movement retarding means is mounted on the left wall of the channel (looking upstream) and the movement expediting means is mounted on the right wall of the channel, the spin imparted to a raft passing between them will be clockwise. Likewise, if the movement retarding means is mounted on the right wall of the channel (looking upstream), and the movement expediting means is mounted on the left wall, the spin imparted to a raft passing between them will be counter-clockwise.

In yet another embodiment, the present invention provides an improved water amusement ride including one or more circular floatation vehicles or rafts, a channel or water course having a floor and two upstanding walls on either side of the floor for directing the flow of water through the channel, and a spin mechanism, as described above, mounted along the water course for imparting a spin to the circular rafts.

Other and further objects, features, advantages and embodiments of the present invention will become apparent to one skilled in the art from reading the Detailed Description of the Invention together with the drawings.

DETAILED DESCRIPTION OF THE INVENTION

Figure 1:
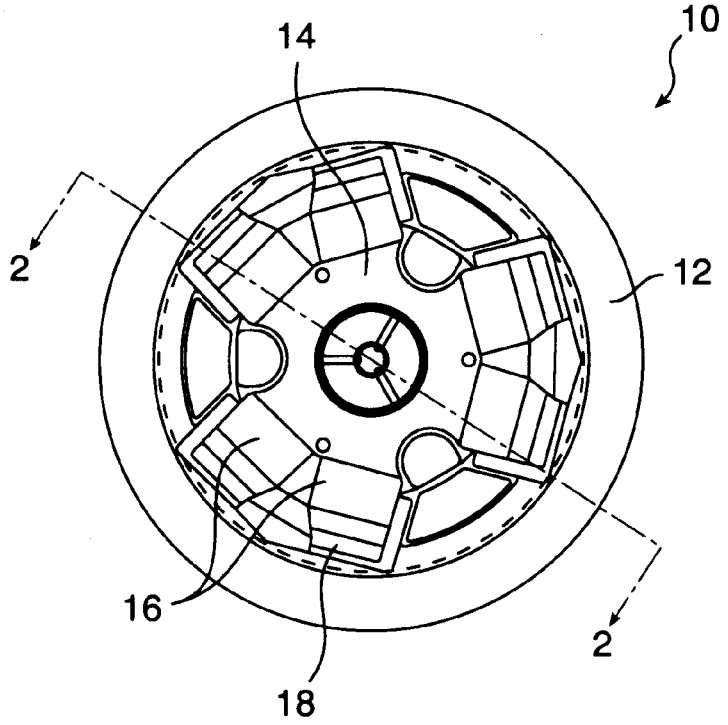
FIG. 1 is a top view of a circular water raft of the present invention.
Figure 2:
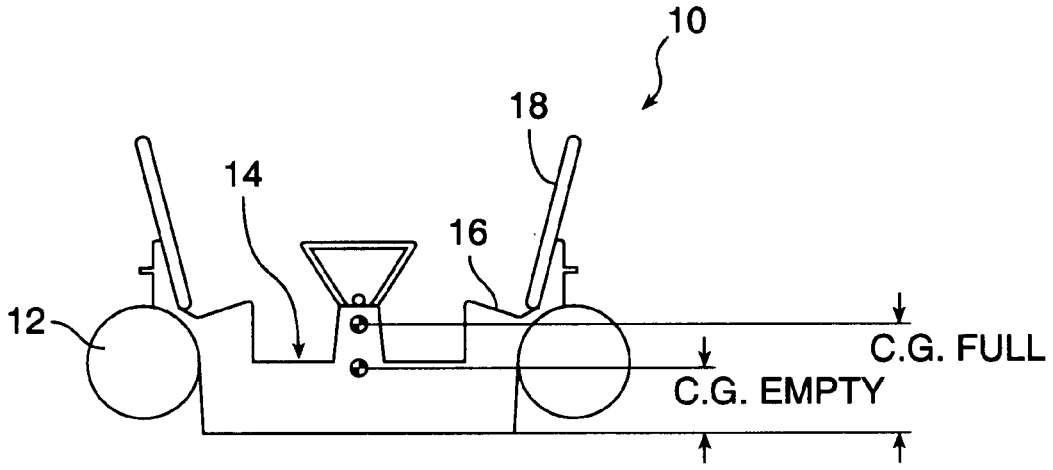
FIG. 2 is a sectional side view of a circular water raft of the present invention.

As shown in FIGS. 1 and 2, a circular raft 10 of the present invention includes an annular ring 12 for floatation. Annular ring 12 can be constructed from rubberized fabric, rubber, or any other material which is suitable for forming a floatation bladder. Most preferably, annular ring 12 is constructed to be inflatable, deformable, and durable to prevent scrapes or other damage which might otherwise result from contact with the sides of a water course or channel. Wear strips, can be provided to reduce abrasion to the annular ring 12. We prefer an annular ring having a cross-sectional radius of about 300 mm (about 11.81 inches), and an outside diameter of about 2900 mm (about 114.17 inches).

A passenger platform 14 is mounted in the center of the ring. The passenger platform 14 is provided with one or more passenger seats 16, which are preferably provided with high seat backs 18 against which passengers can rest their heads. The passenger platform and seats can be constructed as a single unit, or as separate units as described in U.S. Pat. No. 4,696,251, which is incorporated herein by reference. Preferably, the passenger seats and other surfaces contacted by the passengers are molded from, or provided with, a fiberglass or other waterproof covering to minimize water leakage. Conventional safety restraints, such as seat belts, lap bars and the like may be utilized as desired.

A conventional circular water raft, such as a standard 6 passenger raft manufactured and sold by Intamin AG as Raft Model WA-13-7819A can be used with the present invention. We have added steel cladding to the bottom of the passenger platform to provide a wear surface for the raft when sliding down a down ramp and to elevate the annular flotation ring so that it does not rub against the floor 22 of a downramp. We have found, for example, that a modified raft of the present invention (with steel cladding added to provide a wear surface and raise the annular tube) has a mass moment of inertia in its empty state of 474.92 lb-ft-sec$^2$ as compared to 353.38 lb-ft-sec$^2$ for the conventional Intamin vehicle. When fully loaded with 6 passengers, the modified raft of the present invention has a mass moment of inertia of 771.24 lb-ft-sec$^2$, compared to 663.06 lb-ft-sec$^2$ for the conventional Intamin vehicle. When fully loaded with 8 passengers, the modified raft of the present invention has a mass moment of inertia of 870.02 lb-ft-sec$^2$, compared to 761.85 lb-ft-sec$^2$ for the conventional Intamin vehicle. The draft of the modified vehicle when empty is about 8.25 inches; when the raft is loaded with 6 passengers the draft is about 11.25 inches; and when the raft is loaded with 8 passengers the draft is about 13.75 inches. Accordingly, we believe it would be more preferable to incorporate the steel cladding into the raft design without adding additional mass, since responsiveness is increased by keeping the mass moment to a minimum.

Figure 3:
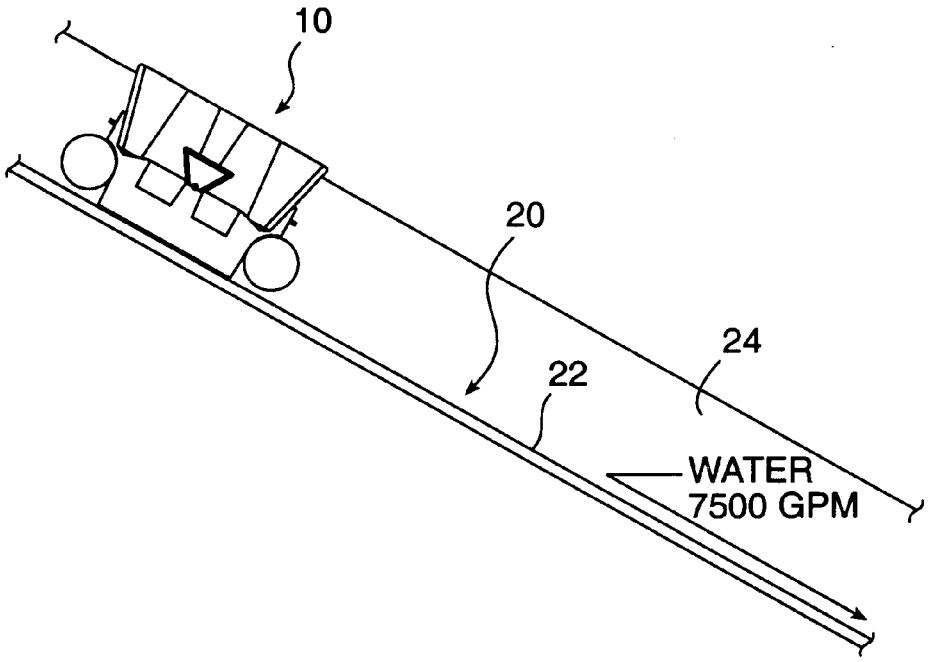
FIG. 3 is a sectional side view of an inclined section along a water course of present invention.
Figure 4:
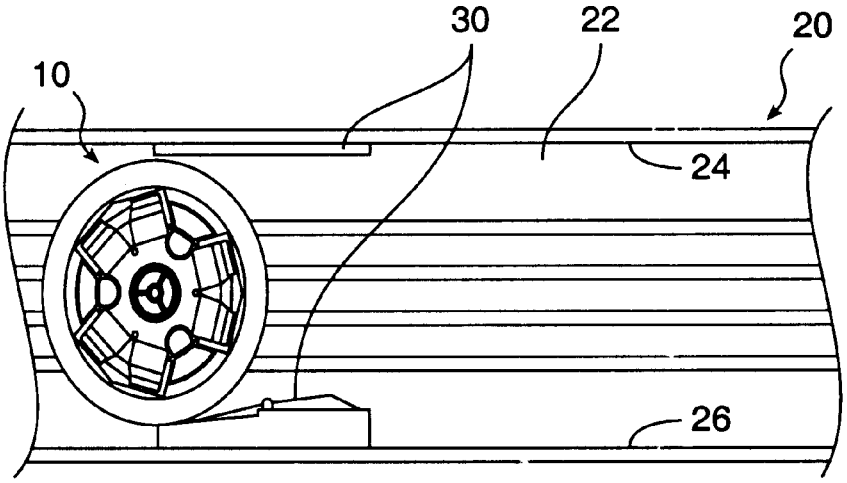
FIG. 4 is a top view of an inclined section along a water course of the present invention.

As shown in FIGS. 3 and 4, a circular raft 10 of the present invention travels along a channel or course 20 along which a flow of water is directed. The water in course 20 is preferably deep enough in substantially horizontal sections to float the raft 10 through the horizontal portions of the water course; the raft 10 typically slides down the floor of a downramp (accelerated by gravity), with the flowing water providing lubrication. We have found a flow of 7500 gallons per minute to provide satisfactory results. Water course 20 is provided with a floor 22, a first wall 24 and a second wall 26 for directing and controlling the flow of water through the water course. A spin apparatus 30 of the present invention can be mounted to the walls 24, 26 of the water course 20 to spin the raft 10 as it moves past the spin apparatus 30.

Figure 7:
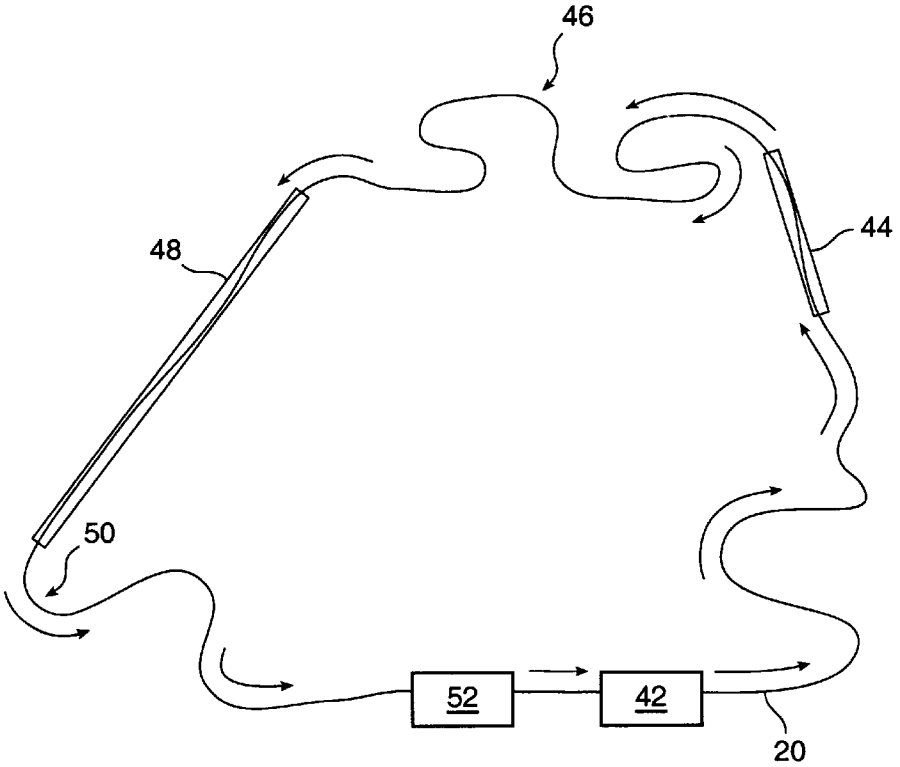

As shown in FIG. 7, water course 20 can be provided with a loading area or zone 42 for loading passengers into the rafts, one or more curves and/or substantially horizontal sections for the rafts to negotiate, a conveyor 44 for carrying the raft uphill to an elevated zone or area 46, a downhill incline or chute 48, leading to a splash point 50, and finally to an unloading zone or station 52. Although a complete circuit, as shown in FIG. 7 is preferred, for convenience in moving the rafts between unloading and loading areas, it would also be possible to provide a course which is not contiguous (e.g., where the rafts are manually returned to the starting point). In such a "one way" system, there would be no need to transport the passengers and raft up a conveyor to the elevated zone before sliding down the inclined chute 48; rather, it would be possible to simply load the passengers at an elevated point, and permit them to travel entirely downhill along the entire route to an unloading station. The rafts could then be mechanically returned to the loading zone.

Figure 5:
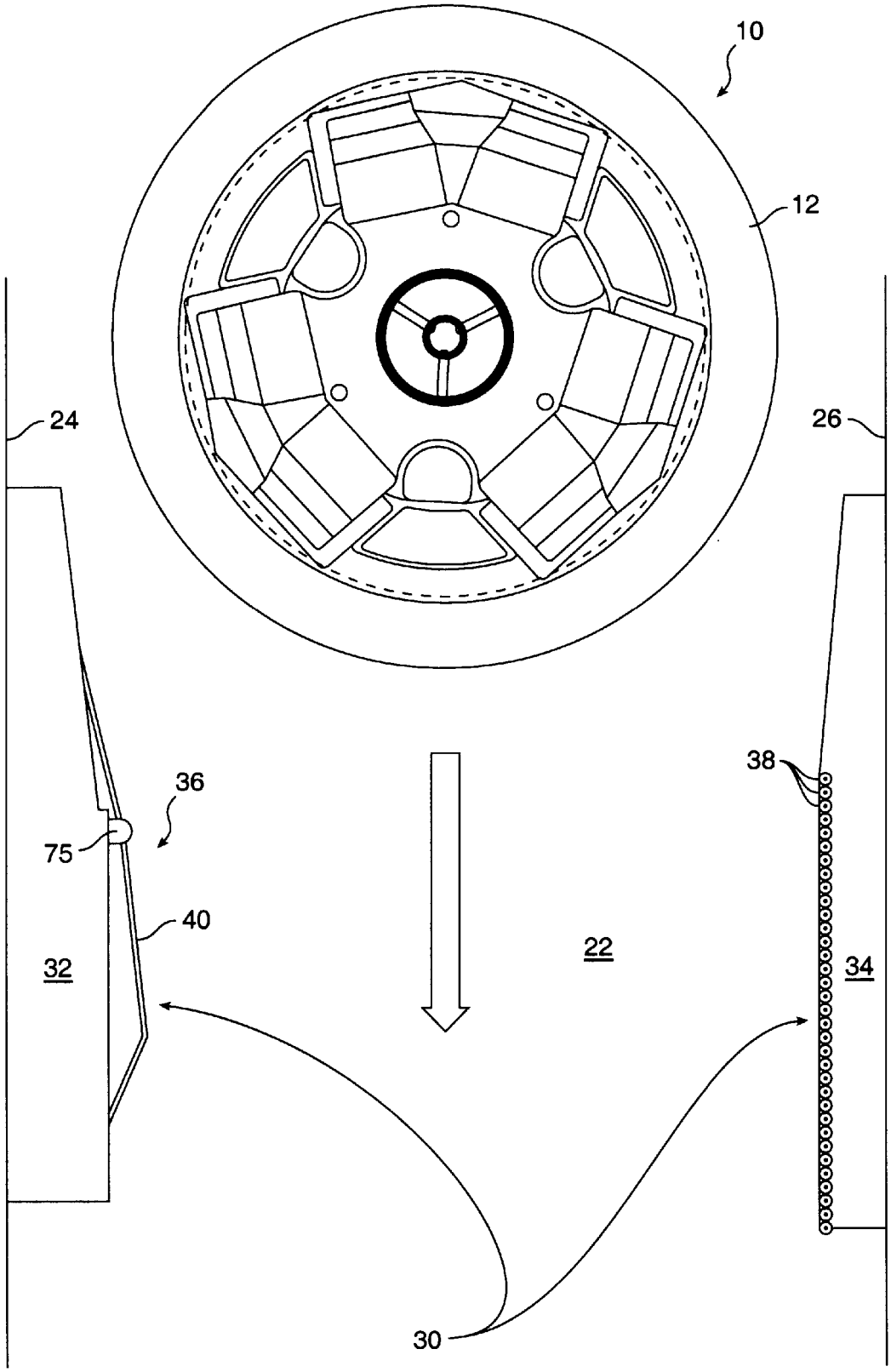
FIG. 5 is a top view of a section of a water course of the present invention, showing in particular a spin mechanism of the present invention.
Figure 6:
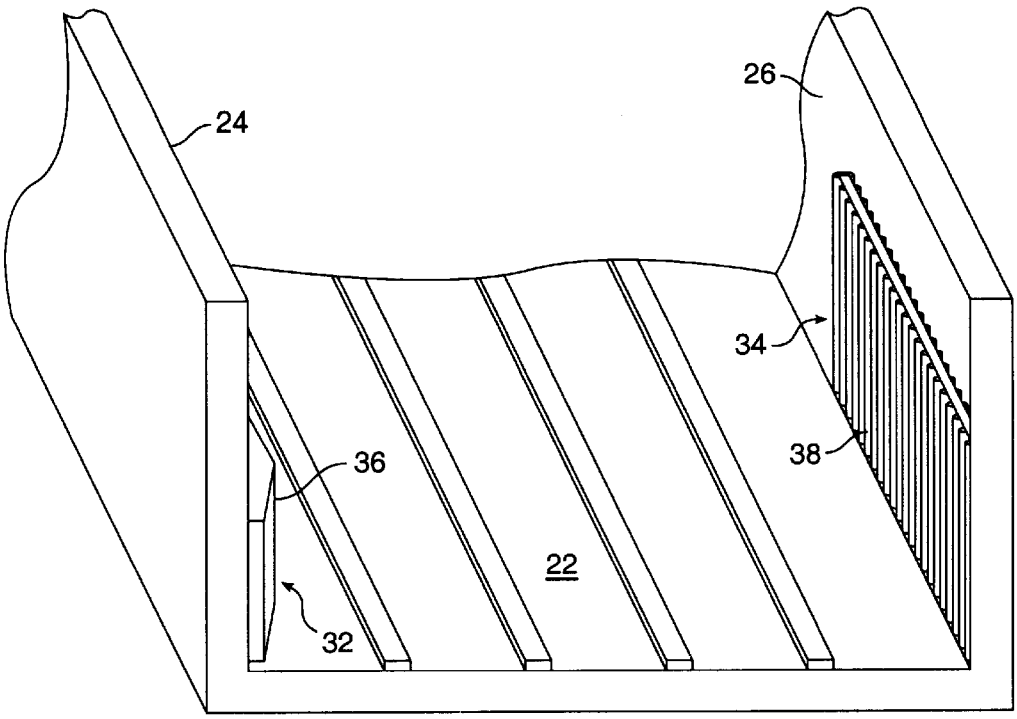
FIG. 6 is a top, perspective view of a water course of the present invention, showing a spin mechanism of the present invention; and, FIG. 7 illustrates a channel for a water ride of the present invention, showing loading and unloading areas, uphill conveyors, curves, and a downhill incline.

As shown in FIGS. 5 and 6, a spin apparatus of the present invention is formed from a movement retarding means 32 and a movement expediting means 34. Movement retarding means 32 can be mounted to first wall 24 and is preferably formed from an angled surface 36 inclining from an upstream portion of the wall, into the water course 22 and into the path of raft 10. Surface 36 can be constructed from any durable, relatively stiff material such as wood or metal, and most preferably includes a surface coating 40 of a material having a high coefficient of friction when in contact with the material from which annular tube 12 is constructed. The purpose for surface 36 is to provide frictional resistance to the downstream movement of that portion of the raft which first comes into contact with the surface 36. Most preferably, surface 36 interacts with the surface of annular tube 12. As the raft moves downstream, the raft surface which first contacts surface 36 of movement retarding means is substantially prevented from sliding along surface 36 by high friction coating 40. As a result, the force of gravity and speed of the water cause the tube 12 to begin to rotate like a tire on pavement. As the raft 10 travels along the inclined surface 36, it moves towards the second wall 26. On the second wall 26, opposite the movement retarding means 32, is mounted the movement expediting means 34. The movement expediting means 32 is intended to provide little or no frictional resistance to the rotating raft, and to provide a reaction force in the direction towards the retarding means 32 which increases the normal force between the raft and the retarding means, thereby increasing the frictional force to insure there is no slippage on the surface of the retarding means 32. Preferably, movement expediting means is formed from a series of rollers 38 (similar to a conveyor turned on its side and mounted to a wall), which can freely rotate about an axis which is perpendicular, or nearly so, to the plane of the down ramp. Thus, when the spinning raft contacts the rollers, the rollers freely rotate and thus offer no resistance to the spinning motion of the raft, which is accelerated by the pull of gravity when the spin apparatus 30 is located along an inclined downhill section, and/or the speed of the water.

As shown in FIG. 5, looking uphill, a clockwise spin is imparted to the raft 10. Alternatively, if the movement retarding means 32 is mounted on the second wall 26 and the movement expediting means 34 is mounted on the first wall 24, a counter-clockwise spin is imparted to the raft 10.

Alternatively, movement expediting means could be formed from a surface having a plurality of freely rotating balls imbedded therein and extending therefrom so as to freely rotate on contact with a moving body, and thus provide no resistance when contacted by the spinning raft. Alternatively, but less preferably, movement expediting means could also be formed from a surface provided with coating having a low coefficient of friction relative to the surface of the raft which contacts it (a low friction coating).

Movement retarding means 32 and movement expediting means 34 can be mounted in a fixed position along the walls 24. 26 to cause every raft 10 which passes between them to spin. Alternatively, and more preferably, the movement retarding means 32 and/or movement expediting means 34 can be mounted for movement towards and away from the opposite wall using conventional means 75 such as, for example, a piston, so that only selected rafts will be rotated. This enables the ride operator to introduce variation in the ride. It would also be possible to provide electromechanical triggers, which could be accessed, for example, by paying a fee, which would allow amusement park guests who are not passengers to cause the spinning of a raft in which a friend or relative is a passenger.

In an amusement ride of the present invention, as shown in FIG. 7, empty rafts are floated along the water course 20 to a loading zone 42 where passengers are loaded onto the rafts. Once all passengers are seated, and any safety restraints are engaged, the raft is released to float in a downstream direction. The water course 20 may be straight, however, it is more interesting to the passengers if the water course 20 is sinuous or curved, and passes through "themed" surroundings. Preferably, a conveyor 44 is provided to remove the raft and passengers from the ground level water course 20 to an elevated water course 46. As at ground level, the elevated area preferably includes themed surroundings. The raft and passengers can be returned to ground level through a series of inclined, downhill sections which can be straight or curved, or on a long, single inclined section 48. When a spin apparatus of the present invention is mounted near the top portion of an inclined section 48, it is encountered by the raft just after the raft has floated over the crest and is being accelerated downhill. As described above in more detail, when the annular tube 12 contacts the movement retarding means, the raft begins to rotate and move towards the opposite wall. When the annular tube contacts the movement expediting means, it encounters no resistance to its rotation, and the spin is accelerated by the force of gravity on the mass of the loaded raft. The result is the raft continues spinning after it passes through the spin apparatus, and typically continues spinning until it bumps against a wall in the splash zone 50. The spinning of the raft introduces much more of an uncertainty regarding who will be splashed when the raft reaches the splash zone 50 than has hitherto been possible to obtain.

One skilled in the art will recognize at once that it would be possible to construct the present invention from a variety of materials and in a variety of different ways. While the preferred embodiments have been described in detail, and shown in the accompanying drawings, it will be evident that various further modification are possible without departing from the scope of the invention as set forth in the appended claims.

What is claimed is:

1. A spin mechanism for use with an amusement ride including one or more circular water rafts constrained within a water course having a floor and upstanding walls for containing and directing a flow of water for carrying said water rafts, the spin mechanism comprising:

a movement retarding means adapted to be interactive with a surface of the water raft for retarding the movement past of said water raft, said movement retarding means mounted to a first wall of the watercourse; and, a movement expediting means adapted to be interactive with the surface of the water raft for permitting free movement past of the water raft, the movement expediting means mounted to a second wall of the watercourse opposite said first wall;

said movement retarding means adapted to be extended a sufficient distance into the watercourse towards said movement expediting means to force a passing water raft into contact with the movement expediting means.

2. The spin mechanism of claim 1 wherein said movement retarding means and said movement expediting means are adapted to be mounted near the top of an inclined surface of the water course.

3. The spin mechanism of claim 1 wherein said movement retarding means is a first surface, inclined in a direction of the flow of water from said first wall towards said second wall, and of sufficient length to force a water raft, traveling along and in contact with the first surface, into contact with the movement expediting means.

4. The spin mechanism of claim 1 wherein said first surface is covered with a substance having a high coefficient of friction while in contact with the surface of the water raft.

5. The spin mechanism of claim 4 wherein said substance is a synthetic or natural rubber.

6. The spin mechanism of claim 1 wherein said movement expediting means comprises a plurality of substantially freely moving members having a circular cross-section along at least one axis.

7. The spin mechanism of claim 6 wherein said members are cylinders mounted for rotation about an axis which is substantially perpendicular to a plane of said floor.

8. The spin mechanism of claim 1 additionally including a means for moving said movement retarding means selectively towards and away from said movement expediting means.

9. An amusement ride comprising:

a water course including a floor and two upstanding walls on either side of said floor for containing and directing a flow of water;

at least one circular water raft having a surface for contacting said walls, and carried along said water course in a downstream direction;

a spin mechanism mounted along said water course, said spin mechanism including a movement retarding means interactive with said surface of said water raft for retarding the movement downstream of said water raft, said movement retarding means mounted to a first wall of the watercourse, a movement expediting means interactive with said surface of said water raft for permitting free movement downstream of the water raft, the movement expediting means mounted to a second wall of the watercourse opposite said first wall, and wherein the movement retarding means extends a sufficient distance into the watercourse towards said movement expediting means to force a passing water raft into contact with the movement expediting means.

10. The amusement ride of claim 9 wherein said water course includes at least one inclined portion down which said water raft will be carried by said flow of water, and wherein said movement retarding means and said movement expediting means are mounted along said inclined portion.

11. The amusement ride of claim 9 wherein said movement retarding means is a first surface, inclined from said first wall towards said second wall in said downstream direction, and of sufficient size to force said water raft into contact with the movement expediting means when said water raft moves in said downstream direction past said movement retarding means.

12. The amusement ride of claim 9 wherein said first surface is covered with a substance having a high coefficient of friction when in contact with said surface of said water raft.

13. The amusement ride of claim 12 wherein said substance is a synthetic or natural rubber.

14. The amusement ride of claim 9 wherein said movement expediting means comprises a plurality of substantially freely moving members having a circular cross-section along at least one axis.

15. The amusement ride of claim 14 wherein said members are cylinders mounted for rotation about an axis which is substantially perpendicular to a plane of said floor.

16. The amusement ride of claim 9 wherein said movement retarding means can be selectively moved towards and away from said movement expediting means.

17. An amusement ride comprising:

a water course including a loading station, an unloading station, and a channel between said loading and unloading zone, said channel including a floor and two upstanding walls on either side of said floor for containing and directing a flow of water, and at least one inclined section located downstream of said loading station, and in which the elevation of said floor inclines downwardly in a downstream direction;

at least one circular water raft having a surface for contacting said walls, and carried along said water course in a downstream direction from said loading station to said unloading station;

a spin mechanism mounted along said water course, said spin mechanism including a movement retarding means interactive with said surface of said water raft for slowing the movement downstream of said water raft, said movement retarding means mounted to a first wall of the watercourse, a movement expediting means interactive with said surface of said water raft for permitting free movement downstream of the water raft, the movement expediting means mounted to a second wall of the watercourse opposite said first wall, and wherein the movement retarding means extends a sufficient distance into the watercourse towards said movement expediting means to force a passing water raft into contact with the movement expediting means.

18. The amusement ride of claim 17 wherein said spin mechanism is located along said inclined section.

19. The amusement ride of claim 17 wherein said movement retarding means is a surface extending in a downstream direction from said first wall towards said second wall and covered with a substance having a relatively high coefficient of friction when in contact with said surface of said water raft.

20. The amusement ride of claim 17 wherein said movement expediting means provides a surface having a relatively low coefficient of friction when in contact with said surface of said water raft.

* * * * *